US009153400B2

(12) United States Patent
Frasure et al.

(10) Patent No.: US 9,153,400 B2
(45) Date of Patent: Oct. 6, 2015

(54) PNEUMATIC DETECTOR INTEGRATED ALARM AND FAULT SWITCH

(71) Applicant: Kidde Technologies, Inc., Wilson, NC (US)

(72) Inventors: David Frasure, Wilson, NC (US); Steven Wallace, Raleigh, NC (US); Harlan Hagge, Knightdale, NC (US); Scott Kenneth Newlin, Willow Spring, NC (US)

(73) Assignee: Kidde Technologies, Inc., Wilson, NC (US)

( * ) Notice: Subject to any disclaimer, the term of this patent is extended or adjusted under 35 U.S.C. 154(b) by 142 days.

(21) Appl. No.: 13/836,675

(22) Filed: Mar. 15, 2013

(65) Prior Publication Data

US 2014/0262723 A1 Sep. 18, 2014

(51) Int. Cl.

| | |
|---|---|
| ***H01H 35/26*** | (2006.01) |
| ***G08B 13/20*** | (2006.01) |
| ***H01H 35/34*** | (2006.01) |
| ***G08B 17/04*** | (2006.01) |

(52) U.S. Cl.

CPC ..... *H01H 35/2671* (2013.01); *G08B 13/20* (2013.01); *G08B 17/04* (2013.01); *H01H 35/34* (2013.01)

(58) Field of Classification Search

CPC ..... H01H 35/346; H01H 35/34

USPC ..... 200/83 Y, 83 R

See application file for complete search history.

(56) References Cited

U.S. PATENT DOCUMENTS

| | | | | |
|---|---|---|---|---|
| 2,777,028 | A * | 1/1957 | Kendall et al. | 200/83 Y |
| 3,122,728 | A | 2/1964 | Lindberg, Jr. | |
| 3,267,233 | A * | 8/1966 | Basile et al. | 200/83 Y |
| 3,585,327 | A * | 6/1971 | Farmery | 200/83 Y |
| 3,710,813 | A | 1/1973 | Hodgman, Jr. | |
| 5,136,278 | A | 8/1992 | Watson et al. | |
| 5,621,389 | A | 4/1997 | Fellows | |
| 5,691,702 | A | 11/1997 | Hay | |
| 6,121,883 | A | 9/2000 | Hatsir | |
| 2009/0236205 | A1 | 9/2009 | Nalla et al. | |
| 2011/0121977 | A1 | 5/2011 | Nalla et al. | |

FOREIGN PATENT DOCUMENTS

| | | | |
|---|---|---|---|
| EP | 0503971 | A1 | 9/1992 |
| WO | WO2009032973 | A2 | 3/2009 |

OTHER PUBLICATIONS

European Search Report, dated Oct. 7, 2014, for European Application No. 14159615.5, 7 pages.

* cited by examiner

*Primary Examiner* — Felix O Figueroa
(74) *Attorney, Agent, or Firm* — Kinney & Lange, P.A.

(57) ABSTRACT

An integrated switch to indicate pressure changes in an environment includes a housing with a cavity between a first retainer portion and a second retainer portion, a first diaphragm held in the cavity of the housing to indicate fault conditions, and a second diaphragm held in the cavity of the housing to indicate alarm conditions.

20 Claims, 4 Drawing Sheets

PNEUMATIC DETECTOR INTEGRATED ALARM AND FAULT SWITCH

BACKGROUND

The present invention relates to a pneumatic detector, and in particular, to a pneumatic detector with an integrated alarm and fault switch.

A pneumatic detector is typically comprised of both an alarm switch and a fault switch. Pneumatic detectors typically utilize a pressure tube that contains a gas that will expand as it is heated, thus increasing the pressure in the tube. An alarm switch is used to indicate overheat or fire situations. An alarm switch will include a deformable diaphragm that is at a normal state when the system is at a normal pressure. As the pressure rises, the diaphragm will deform and close an electrical circuit, indicating that there is an alarm condition in the system. A fault switch is used to indicate whether there are leaks, disconnects, or other problems in a pneumatic detector system. A fault switch will include a deformable diaphragm that is deformed when the system is at a normal pressure. If the pressure drops below normal, the diaphragm will resume its normal state and open an electrical circuit, indicating that there is a fault condition in the system.

Pneumatic detectors that utilize both alarm switches and fault switches are used on aircrafts to detect alarm and fault conditions. The pressure tubes for the alarm and fault switches can typically run anywhere from one foot long to fifty feet long, and can be placed in systems that are prone to overheating or fires.

SUMMARY

According to the present invention, an integrated switch to indicate pressure changes in an environment includes a housing with a cavity between a first retainer portion and a second retainer portion, a first diaphragm held in the cavity of the housing to indicate fault conditions, and a second diaphragm held in the cavity of the housing to indicate alarm conditions.

DETAILED DESCRIPTION

In general, the present invention relates to pneumatic detectors with integrated alarm and fault switches. An integrated alarm and fault switch will have one housing that contains two diaphragms. A first diaphragm will indicate fault conditions and a second diaphragm will indicate alarm conditions. Fault conditions typically occur when there is a disconnection, leak, or other problem in a system. Alarm conditions typically occur when there is overheat or a fire in a system.

Figure 1:
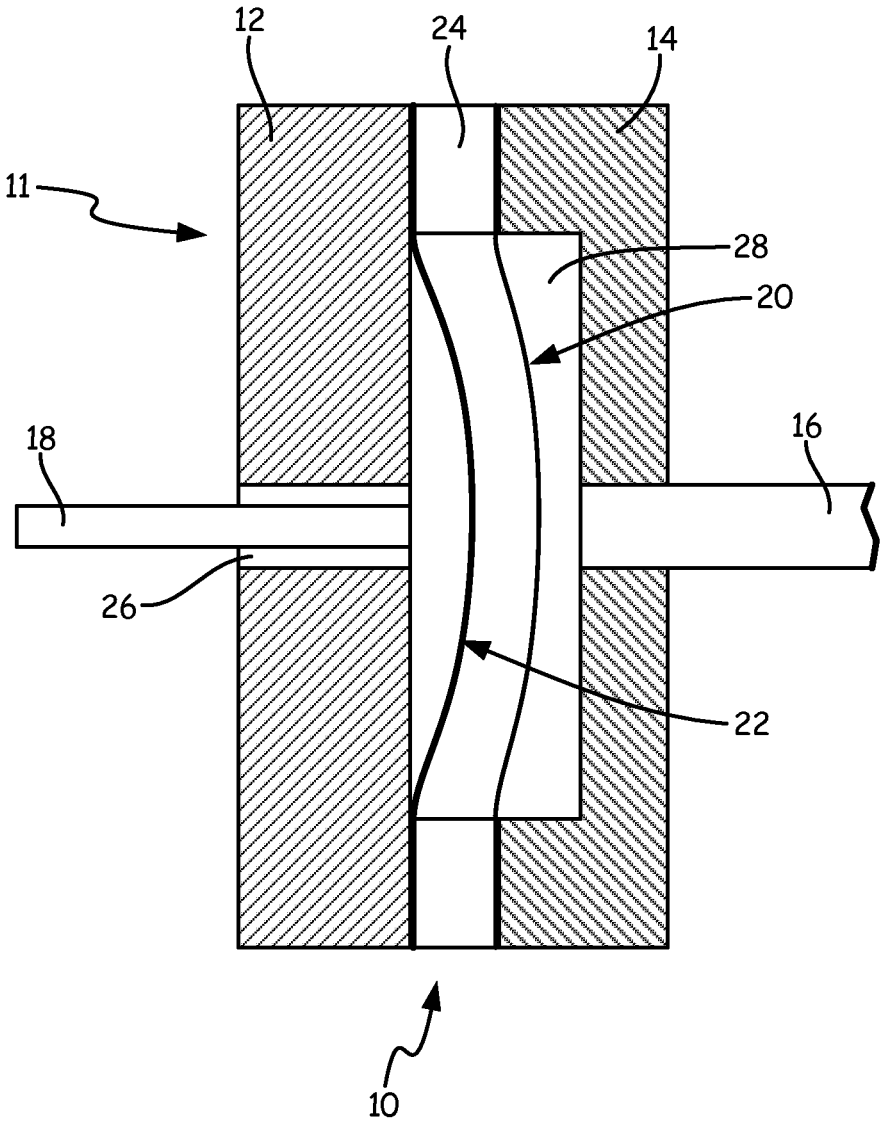
FIG. 1 is a side cross-sectional view of an integrated switch, including both an alarm switch and a fault switch, when there is atmospheric pressure in the integrated switch.

FIG. 1 is a side cross-sectional view of integrated switch 10, including both an alarm switch and a fault switch, when there is atmospheric pressure in integrated switch 10. Integrated switch 10 includes housing 11 (including first retainer portion 12 and second retainer portion 14), pressure tube 16, contact pin 18, fault diaphragm 20, alarm diaphragm 22, insulator 24, insulator 26, and cavity 28. In the embodiment seen, there is no pressure in integrated switch 10.

Integrated switch 10 includes housing 11 that is constructed of first retainer portion 12 and second retainer portion 14. First retainer portion 12 and second retainer portion 14 are connected to one another with insulator 24 running between them. Housing 11 includes cavity 28 that is bound by first retainer portion 12 and second retainer portion 14. First retainer portion 12 contains contact pin 18 with insulator 26 running between first retainer portion 12 and contact pin 18. Second retainer portion 14 contains pressure tube 16. Pressure tube 16 extends into cavity 28. Fault diaphragm 20 and alarm diaphragm 22 are held between first retainer portion 12 and second retainer portion 14 in cavity 28. Fault diaphragm 20 is held in integrated switch 10 between insulator 24 and second retainer portion 14. Alarm diaphragm 22 is held in integrated switch 10 between first retainer portion 12 and insulator 24.

First retainer portion 12 and second retainer portion 14 are constructed out of a refractory metallic material that is capable of conducting an electrical signal. Refractory materials are used so that the components can maintain their strength when they are subject to high temperatures. Fault diaphragm 20 and alarm diaphragm 22 are also constructed out of refractory metallic materials that are capable of conducting an electronic signal. Fault diaphragm 20 and alarm diaphragm 22 can have any thickness that allows fault diaphragm 20 and alarm diaphragm 22 to deform. Fault diaphragm 20 has a smaller thickness in the embodiment shown so that it deforms at lower pressures than alarm diaphragm 22. This allows integrated switch 10 to be used to indicate different pressure levels in integrated switch 10.

Insulator 24 runs between first retainer portion 12 and second retainer portion 14 to insulate the two portions and to prevent electronic signals from being passed between them. Insulator 26 runs between first retainer portion 12 and contact pin 18 to insulate them and to prevent electronic signals from being passed between them. Insulator 24 and insulator 26 can be made of any material that is capable of acting as an electrical insulator.

Pressure tube 16 runs through second retainer portion 14 and connects to cavity 28. Pressure tube 16 contains a gas that expands as it is heated, therefore as pressure tube 16 is heated the pressure in pressure tube 16 will increase. As the pressure in pressure tube 16 increases, the pressure in cavity 28 will also increase. The pressure in cavity 28 can cause fault diaphragm 20 and alarm diaphragm 22 to deform. In the embodiment shown in FIG. 1, there is no pressure in integrated switch 10 and fault diaphragm 20 and alarm diaphragm 22 are in their normal configuration. Pressure tube 16 can have a typical length between 0.305 meters (1 foot) and 15.24 meters (50 feet) depending on where integrated switch 10 will be used. Pressure tube 16 will be placed next to components that are capable of overheating or components where a fire could occur, such as an engine or auxiliary power unit.

Contact pin 18 is held in first retainer portion 12 with insulator 26 running between contact pin 18 and first retainer portion 12. If the pressure in integrated switch 10 gets high enough, fault diaphragm 20 and alarm diaphragm 22 can both deform and come into contact with contact pin 18. A signal can then be sent through contact pin 18. Insulator 26 acts as a barrier and only allows the signal to travel through contact pin 18 and not through first retainer portion 12.

Integrated switch 10 is advantageous over the prior art models, as it is reduced in size and weight. Integrated switch 10 can be used in pneumatic detector systems, making these systems smaller, lighter, and more compact. The reduction in size means integrated switch 10 can be used more efficiently in pneumatic detector systems. A reduction in size and weight also makes integrated switch 10 advantageous for use in applications where space is limited and weight needs to be kept to a minimum. If integrated switch 10 is housed in a housing, having a smaller and lighter system is also advantageous, as the size of the housing needed can be reduced.

Integrated switch 10 also requires less parts than prior art models, which reduces the cost of the system and simplifies the manufacturing process. A lower cost and simpler manufacturing process are advantageous over the prior art systems. An integrated switch is also advantageous over prior art systems that utilized separate fault switches and alarm switches, as it reduces the possibility of having a disconnection, leak, or other problem in the system.

Figure 2:
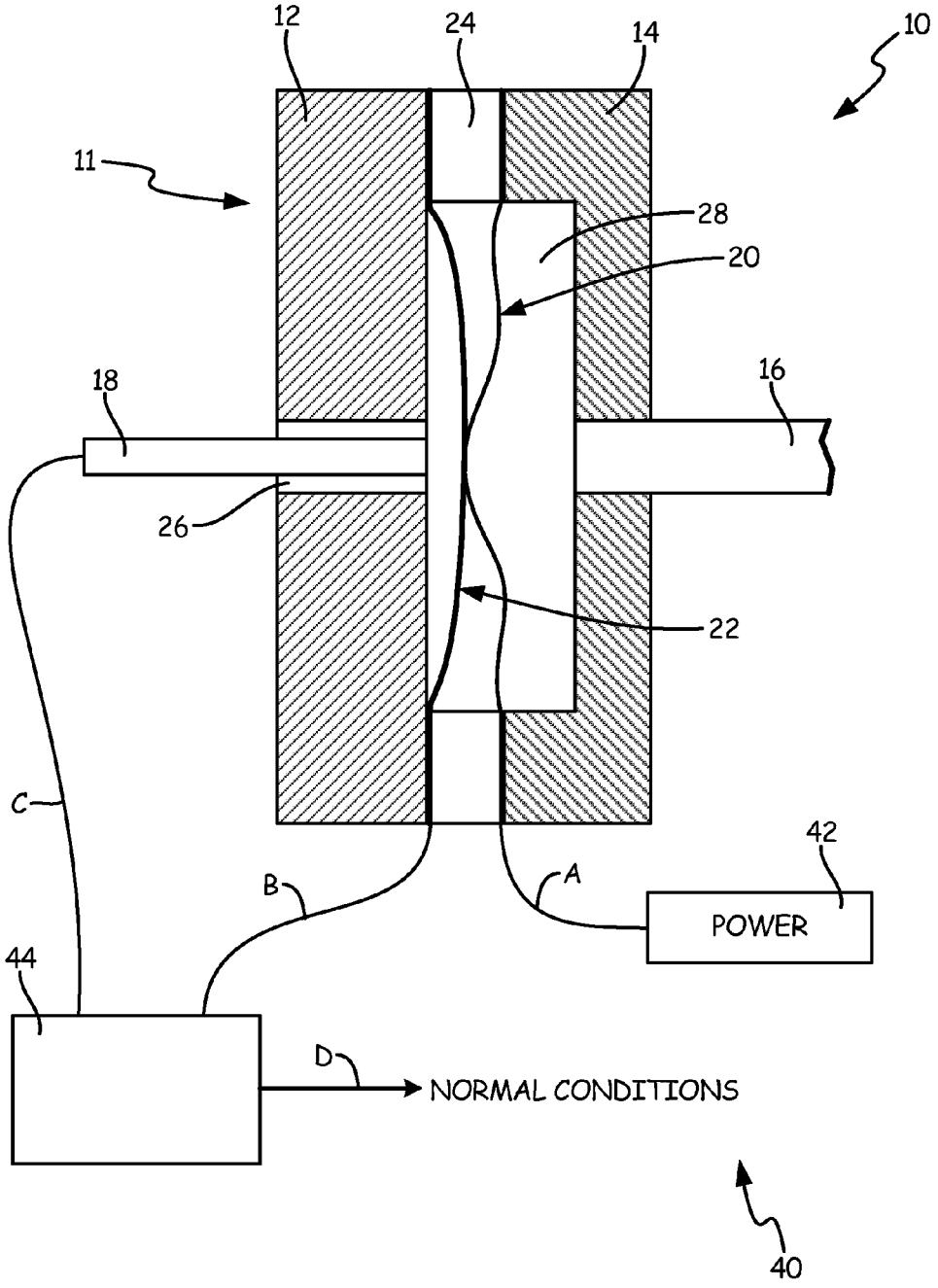
FIG. 2 is a side cross-sectional view of the integrated switch seen in FIG. 1 at a normal pressure.

FIG. 2 is a side cross-sectional view of integrated switch 10 in system 40 at a normal pressure. Integrated switch 10 includes housing 11 (including first retainer portion 12 and second retainer portion 14), pressure tube 16, contact pin 18, fault diaphragm 20, alarm diaphragm 22, insulator 24, insulator 26, and cavity 28. System 40 includes power source 42 and electronic controller 44. Integrated switch 10 and system 40 are connected to one another with path A, path B, path C, and path D.

Integrated switch 10 is included in system 40 in the embodiment shown. System 40 includes power source 42 that is connected to fault diaphragm 20 along path A. Power source 42 can include any power source that is capable of supplying electric power to integrated switch 10. System 40 also includes electronic controller 44. Electronic controller 44 is connected to integrated switch 10 to read the signals being sent from integrated switch 10. Electronic controller 44 is connected to alarm diaphragm 22 along path B and to contact pin 18 along path C. System 40 also includes path D exiting electronic controller 44 to send a signal to an electronic component that will indicate what type of pressure conditions are present in integrated switch 10. These electronic components can include electrical equipment in the cockpit of an aircraft.

FIG. 2 depicts integrated switch 10 at normal pressure conditions. In the embodiment shown, normal pressure conditions exist under normal operating temperatures. Normal operating temperatures exist between a pre-set fault temperature and a pre-set alarm temperature. The pre-set fault temperature defines a lower limit of the normal operating temperatures and is the point at which pressure conditions will drop below normal. Fault diaphragm 20 will deform when the temperature rises above the pre-set fault temperature. The pre-set alarm temperature defines an upper limit of the normal operating temperatures and is the point at which pressure conditions will rise above normal. Alarm diaphragm 22 will deform when the temperature rises above the pre-set alarm temperature. Normal pressure conditions thus exist between the pre-set fault temperature and the pre-set alarm temperature. At normal pressure conditions, fault diaphragm 20 deforms and comes into contact with alarm diaphragm 22.

Under normal pressure conditions, an electronic signal is being sent through fault diaphragm 20 from power source 42. When fault diaphragm 20 comes into contact with alarm diaphragm 22 under normal pressure conditions, an electrical circuit between the two is closed and the electric signal from power source 42 will travel through fault diaphragm 20 to alarm diaphragm 22. This electric signal can then travel through alarm diaphragm 22 and along path B to electronic controller 44. Electronic controller 44 will register this electric signal and will send out a signal along path D indicating that there are normal pressure conditions in integrated switch 10.

Utilizing integrated switch 10 in pneumatic detectors is advantageous, as integrated switch 10 can send a signal that indicates a system is at a steady state. This allows a user to verify that the pneumatic detector is operable and that the system is functioning normally.

Figure 3:
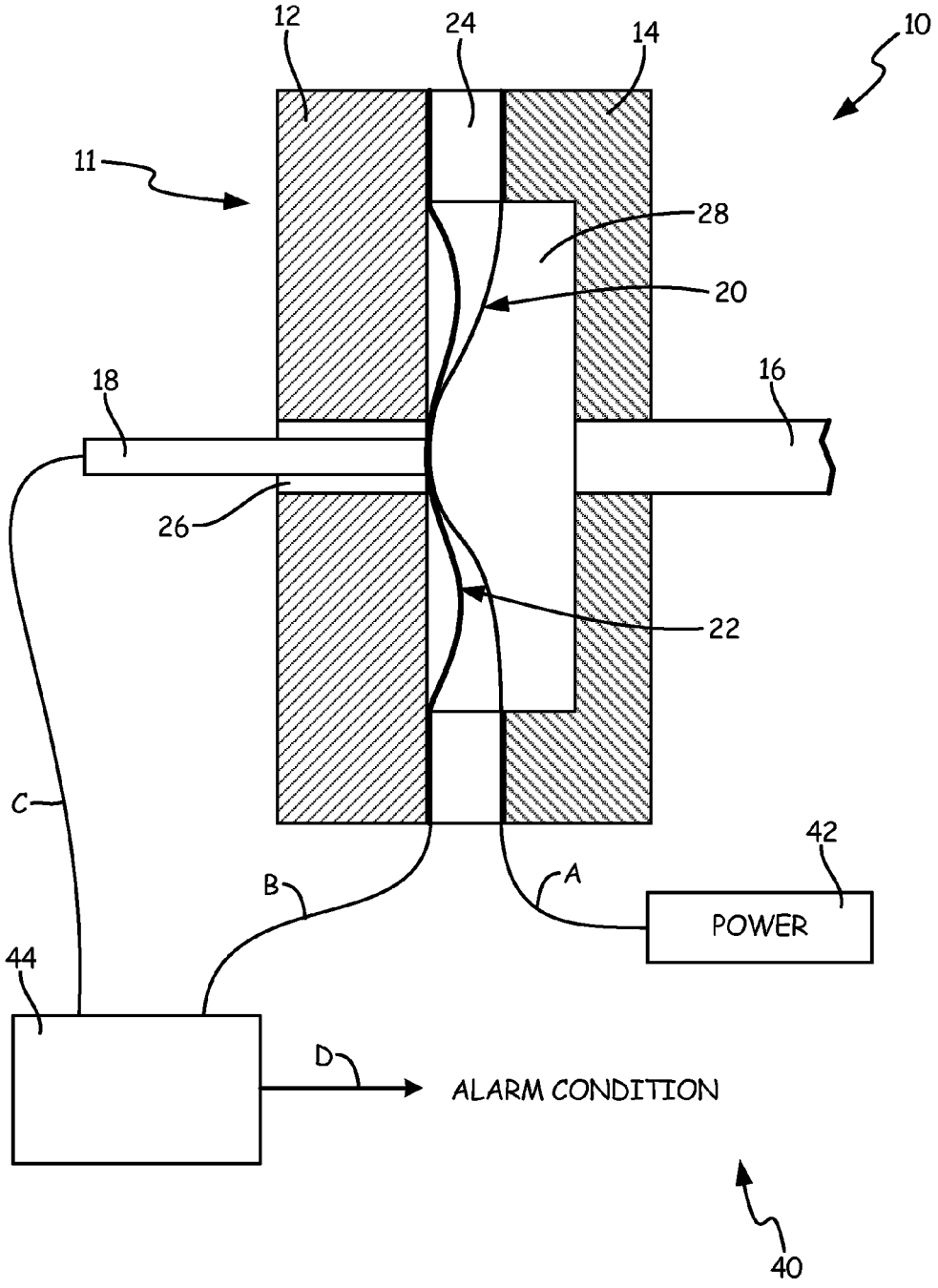
FIG. 3 is a side cross-sectional view of the integrated switch of FIG. 1 at a higher than normal pressure.

FIG. 3 is a side cross-sectional view of the integrated switch of FIG. 2 at a higher than normal pressure. Integrated switch 10 includes housing 11 (including first retainer portion 12 and second retainer portion 14), pressure tube 16, contact pin 18, fault diaphragm 20, alarm diaphragm 22, insulator 24, insulator 26, and cavity 28. System 40 includes power source 42 and electronic controller 44. Integrated switch 10 and system 40 are connected to one another with path A, path B, path C, and path D.

FIG. 3 depicts integrated switch 10 at above normal pressure conditions. Above normal pressure conditions exist at temperatures above the pre-set alarm temperature. In the embodiment shown, the pre-set alarm temperature of the sensor is 316 degrees Celsius (600.00 degrees Fahrenheit). Temperatures above the pre-set alarm temperature of the sensor will cause above normal pressure conditions. In alternate embodiments, the pre-set alarm temperature of the sensor can vary based on the thickness of alarm diaphragm 22 in integrated switch 10 and the quantity of gas contained in pressure tube 16. At above normal pressure conditions, both fault diaphragm 20 and alarm diaphragm 22 will deform. This will cause fault diaphragm 20 to come into contact with alarm diaphragm 22 and it will cause alarm diaphragm 22 to come into contact with contact pin 18.

In operation, an electronic signal is being sent through fault diaphragm 20 from power source 42. When fault diaphragm 20 comes into contact with alarm diaphragm 22 under normal pressure conditions, an electrical circuit between the two is closed and the electric signal from power source 42 will travel through fault diaphragm 20 to alarm diaphragm 22. When alarm diaphragm 22 comes into contact with contact pin 18, an electrical circuit between them is closed and the electric signal will travel through alarm diaphragm 22 to contact pin 18. This electric signal can then travel through contact pin 18 and along path C to electronic controller 44. Electronic controller 44 will register this electric signal and will send out a signal along path D indicating that there are above normal pressure conditions in integrated switch 10.

Above normal pressure conditions can occur when there is a fire or overheat condition in a component, such as an engine or auxiliary power unit. Pressure tube 16 can run along these components. As the heat rises in or around the components, the pressure in pressure tube 16 will increase, which will increase the pressure in cavity 28 of integrated switch 10. If the temperatures get above the pre-set alarm temperature, the pressure will get high enough to cause alarm diaphragm 22 to deform and come into contact with contact pin 18. This closes the circuit between alarm diaphragm 22 and contact pin 18 and causes an electric signal to travel between the two. This signal will be sent to electronic controller 44. Electronic controller 44 can then send a signal indicating that there is an alarm condition in integrated switch 10.

Figure 4:
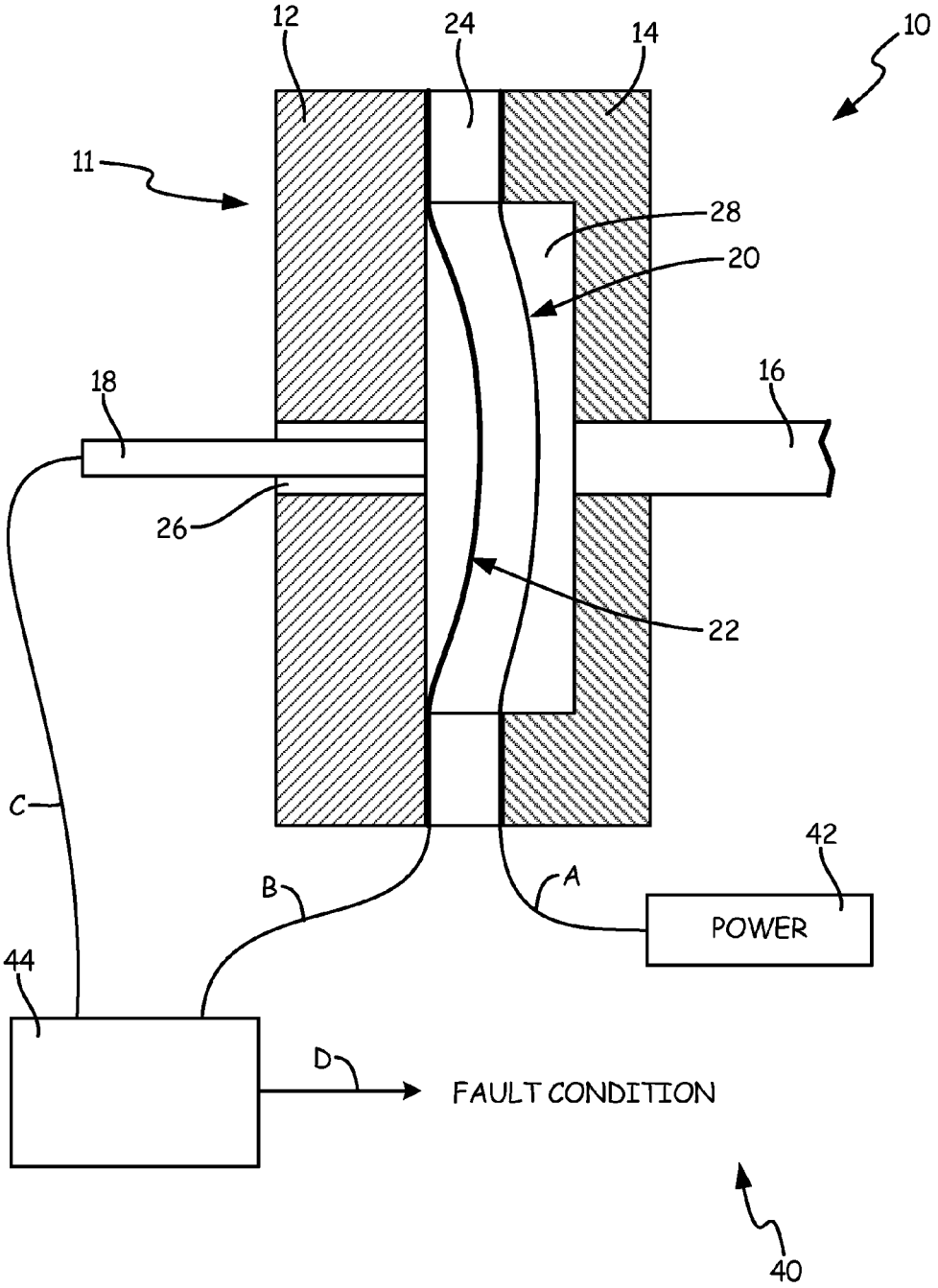
FIG. 4 is a side cross-sectional view of the integrated switch of FIG. 1 at a lower than normal pressure.

FIG. 4 is a side cross-sectional view of the integrated switch of FIG. 2 at a lower than normal pressure. Integrated switch 10 includes housing 11 (including first retainer portion 12 and second retainer portion 14), pressure tube 16, contact pin 18, fault diaphragm 20, alarm diaphragm 22, insulator 24, insulator 26, and cavity 28. System 40 includes power source 42 and electronic controller 44. Integrated switch 10 and system 40 are connected to one another with path A, path B, path C, and path D.

FIG. 4 depicts integrated switch 10 at below normal pressure conditions. Below normal pressure conditions exist at temperatures below the pre-set fault temperature of the sensor. In the embodiment shown, the pre-set fault temperature of the sensor is −54 degrees Celsius (−65 degrees Fahrenheit), which is the temperature at a lower limit of the normal operating temperatures. Temperatures below the pre-set fault temperature of the sensor will cause below normal pressure conditions. In alternate embodiments, the pre-set fault temperature of the sensor can vary based on the thickness of fault diaphragm 20 in integrated switch 10. At below normal pressure conditions, both fault diaphragm 20 and alarm diaphragm 22 will be in their normal configuration and they will not be touching.

In operation, an electronic signal is being sent through fault diaphragm 20 from power source 42. Because fault diaphragm 20 is not in contact with alarm diaphragm 22 when there are below normal pressure conditions, an electrical circuit between the two is open. The electric signal from power source 42 will not travel through fault diaphragm 20 and alarm diaphragm 22 to electronic controller 44. Electronic controller 44 will register that there is no electric signal coming in and will send out a signal along path D indicating that there are below normal pressure conditions in integrated switch 10.

Below normal pressure conditions can occur when there is a leak, disconnect, or other problem in pressure tube 16 or integrated switch 10. If there is a leak or disconnect, the pressure in pressure tube 16 and cavity 28 of integrated switch 10 will decrease. As the pressure decreases, both alarm diaphragm 22 and fault diaphragm 20 will retain their normal configurations and will not be touching. This will open the circuit between alarm diaphragm 22 and fault diaphragm 20 and will prevent a signal from traveling along path B to electronic controller 44. The lack of a signal entering electronic controller 44 will indicate that there is a fault condition in the system. Electronic controller 44 can then send a signal along path D indicating that there is a fault condition in integrated switch 10.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. An integrated switch to indicate pressure changes in an environment, the integrated switch comprising:
- a housing with a cavity between a first retainer portion and a second retainer portion;
- a first diaphragm made entirely out of a metallic material and held in the cavity of the housing to indicate fault conditions; and
- a second diaphragm made entirely out of a metallic material and held in the cavity of the housing to indicate alarm conditions;
- wherein the first diaphragm is thinner than the second diaphragm.

2. The integrated switch of claim 1, wherein the first diaphragm and the second diaphragm are constructed out of refractory metallic materials that are capable of conducting an electrical signal.

3. The integrated switch of claim 1, wherein normal pressure conditions exist at normal operating temperatures.

4. The integrated switch of claim 3, wherein normal operating temperatures are temperatures between a pre-set fault temperature and a pre-set alarm temperature.

5. The integrated switch of claim 4, wherein when there are normal pressure conditions, the first diaphragm deforms and the second diaphragm is in a normal undeformed configuration.

6. The integrated switch of claim 4, wherein when there are below normal pressure conditions, the first diaphragm and the second diaphragm are both in a normal undeformed configuration.

7. The integrated switch of claim 4, wherein when there are above normal pressure conditions, the first diaphragm and the second diaphragm are both deformed.

8. The integrated switch of claim 1, wherein the cavity in the housing is configured to contain a gas.

9. An integrated switch for use in an advanced pneumatic detector system to indicate pressure changes in an environment, the integrated switch comprising:
- a housing with a cavity between a first retainer portion and a second retainer portion, wherein the cavity is configured to contain a gas that will expand as the gas is heated;
- a contact pin held in the first retainer portion with an insulating material that surrounds the contact pin and that is positioned between the contact pin and the first retainer portion;
- a pressure tube connected to the cavity and running through the second retainer portion;
- a fault diaphragm held in the cavity of the housing near the second retainer portion; and
- an alarm diaphragm held in the cavity of the housing near the first retainer portion.

10. The integrated switch of claim 9, wherein the fault diaphragm has a smaller thickness than the alarm diaphragm.

11. The integrated switch of claim 9, wherein the pressure tube contains a gas that expands as the gas is heated.

12. The integrated switch of claim 9, wherein normal pressure conditions exist at normal operating temperatures between a pre-set fault temperature and a pre-set alarm temperature.

13. The integrated switch of claim 12, wherein when there are normal pressure conditions, the fault diaphragm deforms and comes into contact with the alarm diaphragm.

14. The integrated switch of claim 12, wherein when there are below normal pressure conditions, the fault diaphragm and the alarm diaphragm are in a normal undeformed configuration and are not contacting one another.

15. The integrated switch of claim 12, wherein when there are above normal pressure conditions, the fault diaphragm and the alarm diaphragm both deform and the alarm diaphragm comes into contact with the contact pin.

16. An integrated switch in an electrical circuit for indicating pressure changes in an environment, the integrated switch comprising:
- a housing with a cavity between a first retainer portion and a second retainer portion;
- an insulating material between the first retainer portion and the second retainer portion;
- a contact pin held in the first retainer portion with an insulating material between the contact pin and the first retainer portion;

a pressure tube connected to the cavity and running through the second retainer portion;

a fault diaphragm held in the cavity of the housing near the second retainer portion;

an alarm diaphragm held in the cavity of the housing near the first retainer portion; and a power source connected to the fault diaphragm when the fault diaphragm is in a normal undeformed configuration and when the fault diaphragm is deformed.

17. The integrated switch of claim 16, wherein normal pressure conditions exist at normal operating temperatures between a pre-set fault temperature and a pre-set alarm temperature.

18. The integrated switch of claim 17, wherein under normal pressure conditions the fault diaphragm deforms and comes into contact with the alarm diaphragm, which sends a signal from the power source through the fault diaphragm and to the alarm diaphragm.

19. The integrated switch of claim 17, wherein when there are below normal pressure conditions, the fault diaphragm and the alarm diaphragm are in a normal undeformed configuration and are not contacting one another, which prevents the power source from sending a signal to the alarm diaphragm.

20. The integrated switch of claim 17, wherein when there are above normal pressure conditions, the fault diaphragm and the alarm diaphragm both deform and the alarm diaphragm comes into contact with the contact pin, which sends a signal from the power source through the fault diaphragm and the alarm diaphragm to the contact pin.

* * * * *